US009570256B2

(12) United States Patent
Yanagi et al.

(10) Patent No.: US 9,570,256 B2
(45) Date of Patent: Feb. 14, 2017

(54) GAS CIRCUIT BREAKER

(71) Applicant: Kabushiki Kaisha Toshiba, Tokyo (JP)

(72) Inventors: Kosuke Yanagi, Kanagawa-ken (JP); Kozo Matsushita, Kanagawa-ken (JP); Atsushi Nakagawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 152 days.

(21) Appl. No.: 14/306,738

(22) Filed: Jun. 17, 2014

(65) Prior Publication Data

US 2015/0027985 A1 Jan. 29, 2015

(30) Foreign Application Priority Data

Jul. 23, 2013 (JP) ..... 2013-153109

(51) Int. Cl.
*H01H 33/64* (2006.01)

(52) U.S. Cl.
CPC ..... *H01H 33/64* (2013.01)

(58) Field of Classification Search
CPC ..... H01H 33/38; H01H 33/42; H01H 33/64; H01H 9/0027; H01H 9/0038; H01H 9/0044; H01H 19/025; H01H 1/226; H01H 2009/365; H01H 2205/002; H01H 2221/01; H01H 2231/052; H01H 2300/018; H01H 33/161; H01H 33/56; H01H 33/666
USPC ..... 218/7, 13, 14, 78, 153, 154
See application file for complete search history.

(56) References Cited

U.S. PATENT DOCUMENTS 3,813,506 A * 5/1974 Mitchell ..... H01H 33/666 218/10
4,027,125 A * 5/1977 Peek ..... H01H 3/30 200/308
4,513,208 A * 4/1985 Kamata ..... H01H 9/168 218/84
4,550,234 A * 10/1985 Steinemer ..... H01H 33/666 200/502
8,957,341 B2 * 2/2015 Zhang ..... H01H 33/24 218/43

(Continued)

FOREIGN PATENT DOCUMENTS

CN 103177899 A 6/2013
JP 2009-059581 A 3/2009

OTHER PUBLICATIONS

Office Action issued in related Chinese Application No. 201410353700.9, mailed Sep. 29, 2016 (13 pages).

*Primary Examiner* — Truc Nguyen
(74) *Attorney, Agent, or Firm* — Baker Botts L.L.P.

(57) ABSTRACT

A gas circuit breaker includes a hermetically-sealed container filled with an arc extinguishing gas, a fixed contact arranged within the container, a movable contact arranged to face the fixed contact and configured to move in an axial direction of the container, the movable contact capable of contacting or separating from the fixed contact, an insulating operation rod having one end connected to an end of the movable contact opposite to the fixed contact through a link at an angle of about 90 degrees with respect to the movable contact, and an actuator arranged in a substantially coaxial relationship with the insulating operation rod, the actuator including an output shaft transferring a driving force for the operation of the movable contact to the other end of the insulating operation rod.

12 Claims, 11 Drawing Sheets

(56) References Cited

U.S. PATENT DOCUMENTS

| | | | | |
|---|---|---|---|---|
| 2013/0161290 | A1* | 6/2013 | Zhang | H01H 33/24<br>218/78 |
| 2015/0027985 | A1* | 1/2015 | Yanagi | H01H 33/64<br>218/46 |

* cited by examiner

GAS CIRCUIT BREAKER

CROSS REFERENCE TO RELATED APPLICATION

This application claims priority to Japanese Patent No. 2013-153109, filed on Jul. 23, 2013, the entire contents of which are incorporated herein by reference.

TECHNICAL FIELD

The present disclosure relates to a gas circuit breaker.

BACKGROUND

As a protection-purpose circuit breaker for performing a current switching operation in an electric power system, a gas circuit breaker in which an electric current is cut off by filling an arc extinguishing gas into a hermetically-sealed container formed of a grounded metal or a porcelain bushing is widely used.

As one example of conventional gas circuit breakers, a double-point-break gas circuit breaker having two interrupting chambers is shown in FIG. 11.

FIG. 11 is a frontal sectional view of a conventional gas circuit breaker.

The conventional gas circuit breaker includes a container 101, a support insulation tube 103, interrupting chambers 104, a breaker unit 105, a fixed contact 106, a movable contact 107, a first link group 108, an insulating operation rod 109, a unit box 110, an operating mechanism 111, an actuator 112, an output shaft 113, a second link group 114, container supports 115 and an base 116.

The container 101 is filled with an arc extinguishing gas such as $SF_6$ (sulfur hexafluoride) or $CO_2$ (carbon dioxide). The support insulation tube 103 is installed substantially perpendicularly to an axial direction of the container 101, at a nearly central position in the axial direction of the container 101. The breaker unit 105 provided with two interrupting chambers 104 (the right interrupting chamber omitted in FIG. 11) is supported by the support insulation tube 103.

Each of the interrupting chambers 104 includes a fixed contact 106 fixed in a specified position of the container 101 and a movable contact 107 movable in the axial direction of the container 101. The fixed contact 106 and the movable contact 107 are arranged to face each other.

The insulating operation rod 109 extending through a substantially central portion of the support insulation tube 103 is connected through the first link group 108 to an end of the movable contact 107 opposite to the fixed contact 106.

Attached to the external portion of the container 101 is the unit box 110 in which the operating mechanism 111 is placed.

The operating mechanism 111 includes an actuator 112 and a hydraulic mechanism or a spring mechanism, which are not shown in the drawings. The actuator 112 converts the energy generated by the hydraulic mechanism or the spring mechanism (not shown) to a driving force required in a switching operation of electrical contacts.

One end of the insulating operation rod 109 and an output shaft 113 of the actuator 112 are connected to each other through the second link group 114, wherein the insulating operation rod 109 and the output shaft 113 of the actuator 112 are in a positional relationship of about 90 degrees.

The container 101 is installed on the base 116 by the container supports 115 arranged in, e.g., four corners.

In the conventional gas circuit breaker as configured above, the driving force of the actuator 112 acting in the direction of arrow G is transferred to the movable contact 107 via the second link group 114, the insulating operation rod 109 and the first link group 108, thereby driving the movable contact 107 in the direction of arrow G. In other words, the driving force of the actuator 112 acting in the direction of arrow G is first converted to a force in a direction of arrow H by the second link group 114 and is then converted to a force in the direction of arrow G by the first link group 108.

As the movable contact 107 is driven in the direction of arrow G, the fixed contact 106 and the movable contact 107 are contacted and separated from each other, consequently performing the switching operation of a circuit.

In the conventional gas circuit breaker stated above, due to the use of two link groups 108 and 114, the energy loss during the transfer of the driving force of the actuator 112 to the movable contact 107 becomes larger.

SUMMARY

It is an object of the present invention to provide a gas circuit breaker capable of reducing the energy loss of a driving force from an actuator.

A gas circuit breaker according to embodiments includes: a hermetically-sealed container filled with an arc extinguishing gas, a fixed contact arranged within the container, a movable contact arranged to face the fixed contact and configured to move in an axial direction of the container, the movable contact capable of contacting or separating from the fixed contact, an insulating operation rod having one end connected to an end of the movable contact opposite to the fixed contact through a link at an angle of about 90 degrees with respect to the movable contact; and an actuator arranged in a substantially coaxial relationship with the insulating operation rod, the actuator including an output shaft for transferring a driving force for the operation of the movable contact to the other end of the insulating operation rod.

BRIEF DESCRIPTION OF THE DRAWINGS

The FIG. 1 is a front sectional view showing a gas circuit breaker according to a first embodiment.

DETAILED DESCRIPTION

Embodiments will now be described with reference to the accompanying drawings.

First Embodiment

Figure 1:
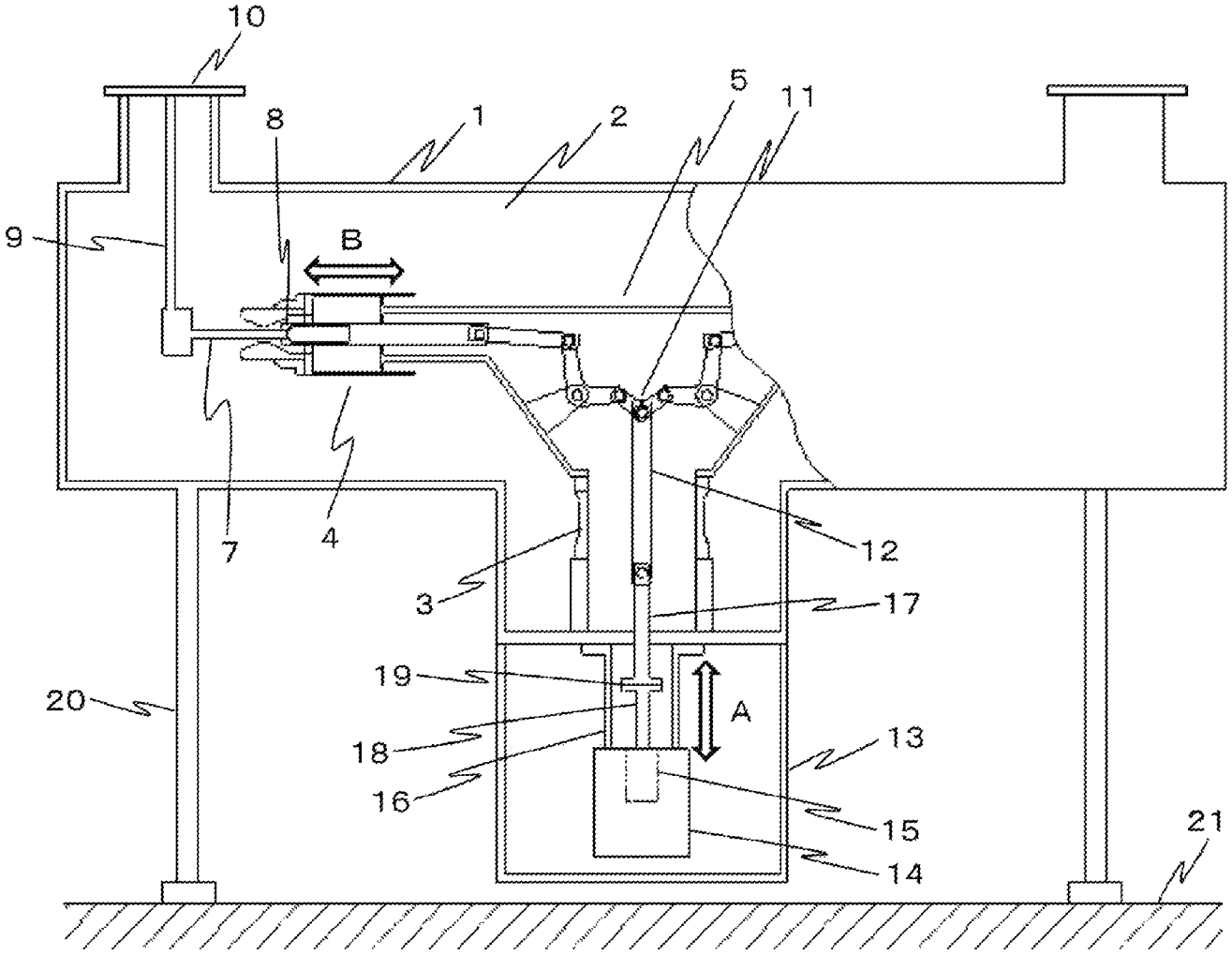

FIG. 1 is a front sectional view showing a gas circuit breaker according to a first embodiment.

The gas circuit breaker of the present embodiment includes a container 1, a support insulation tube 3, interrupting chambers 4, a breaker unit 5, a fixed contact 7, a movable contact 8, a main circuit conductor 9, an interface portion 10, a link group 11, an insulating operation rod 12, a unit box 13, an operating mechanism 14, an actuator 15, a unit support 16, a seal rod 17 and container supports 20.

The container 1 is filled with an arc extinguishing gas such as $SF_6$ (sulfur hexafluoride) or $CO_2$ (carbon dioxide). The support insulation tube 3 is installed within the container 1 in a substantially perpendicular to the axial direction of the container 1. The breaker unit 5 including two interrupting chambers 4 arranged in positions substantially symmetrical to each other with respect to the support insulation tube 3 (the right interrupting chamber omitted in FIG. 1) is supported by the support insulation tube 3.

Each of the interrupting chambers 4 includes a fixed contact 7 fixed in a specified position of the container 1 and a movable contact 8 movable in the axial direction of the container 1. The fixed contact 7 and the movable contact 8 are arranged to face each other.

An end of the fixed contact 7 opposite to the movable contact 8 is electrically connected to the main circuit conductor 9 in a relationship of about 90 degrees (including 90 degrees). The main circuit conductor 9 is connected to a bus conductor or a bushing, etc., (not shown) through the interface portion 10.

An end of the movable contact 8 opposite to the fixed contact 7 is connected to one end of the insulating operation rod 12 extending through the substantially central portion of the support insulation tube 3 through the link group 11. In other words, the movable contact 8 and the insulating operation rod 12 are in a positional relationship of about 90 degrees (including 90 degrees).

The unit box 13 is attached to the external portion of the container 1. The operating mechanism 14 is placed within the unit box 13.

The operating mechanism 14 includes an actuator 15 and a hydraulic mechanism or a spring mechanism (not shown). The actuator 15 converts the energy generated by the hydraulic mechanism or the spring mechanism (not shown) to a driving force required in a breaking operation.

An output shaft 18 is installed in the actuator 15. The end of the output shaft 18 is connected to one end of the seal rod 17. The other end of the seal rod 17 is connected to the end of the insulating operation rod 12 opposite to the link group 11, whereby the driving force from the actuator 15 is transferred to the movable contact 8. Further, the insulating operation rod 12, the seal rod 17 and the output shaft 18 of the actuator 15 are arranged substantially on the same axis.

The insulating operation rod 12 is made of an insulating material including a resin such as epoxy or Teflon (registered trademark) and a composite material such as FRP or the like, to thereby electrically insulate the operating mechanism 14 from the breaker unit 5.

Since the seal rod 17 extends through the unit box 13 kept in the atmosphere and the container 1 filled with an arc extinguishing gas 2, a sealing unit (not shown) is installed on the sliding surface of the seal rod 17 and in the through-hole portion of the container 1, thereby maintaining the airtightness.

The operating mechanism 14 is supported by a tubular unit support 16 installed between the container 1 and the operating mechanism 14. In the tubular unit support 16, a connection portion 19 for connecting the seal rod 17 to the output shaft 18 of the actuator 15 is positioned.

The term "tubular" used herein is not limited to a cylindrical tube but is intended to include a square tube and so forth.

At least one surface of the unit box 13 is detachable so that the operating mechanism 14 can be taken out from or placed into the unit box 13.

When taking out the operating mechanism 14 from the unit box 13, the connection portion 19 for interconnecting the seal rod 17 and the output shaft 18 of the actuator 15 is disconnected.

The container 1 is installed on the base 21 by four container supports 20 in such a manner that two of container supports 20 are arranged near to one end of the container 1 while the other two arranged near to the other end portion of the container 1.

Next, the breaking operation of the gas circuit breaker of the first embodiment configured above will be described with reference to FIG. 1.

The driving force of the actuator 15 acting in the direction of arrow A (see FIG. 1) is transferred to the movable contact 8 via the seal rod 17, the insulating operation rod 12 and the link group 11, thereby driving the movable contact 8 in the direction of arrow B (see FIG. 1) which is at about 90 degrees with the arrow A. In other words, the driving force of the actuator 15 acting in the direction of arrow A is converted to a force acting in the direction of arrow B by the link group 11.

As the movable contact 8 is driven in the direction of arrow B, the fixed contact 7 and the movable contact 8 are contacted to or separated from each other, thereby performing a switching operation of an electric current.

The right interrupting chamber not shown in FIG. 1 has the same configuration and operates in the same manner.

Figure 11:
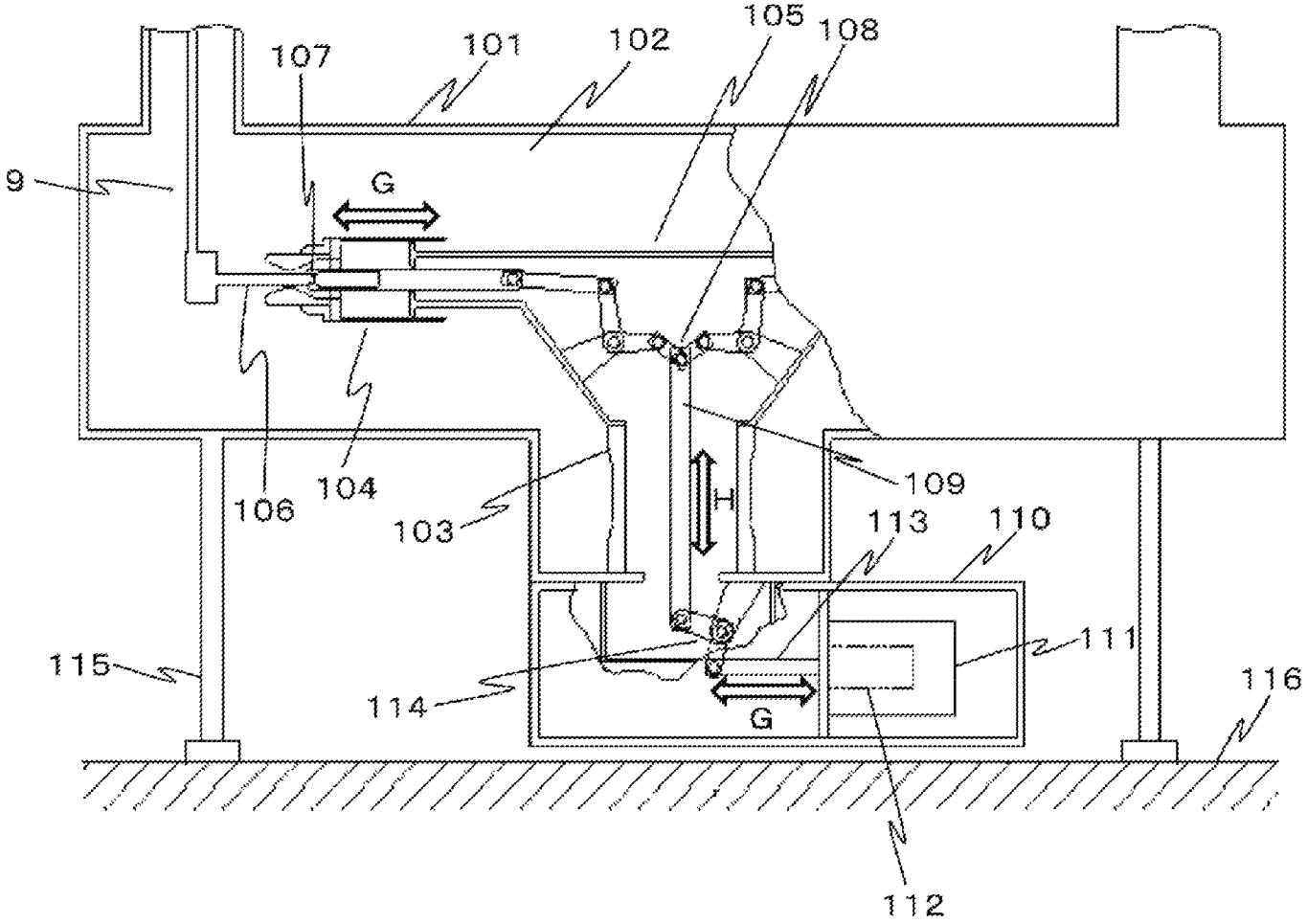
FIG. 11 (Prior Art)
FIG. 11 is a front sectional view showing a conventional gas circuit breaker.

In the conventional gas circuit breaker shown in FIG. 11, the driving force of the actuator 112 is transferred to the movable contact 107 via the two link groups 108 and 114. Thus, the energy loss of the driving force of the actuator 15 is larger due to the frictional forces generated in the link groups 108 and 114, the increase of the driving mass caused by the components of the link groups 108 and 114, and the time delay in transferring the force between the components of the link groups 108 and 114 caused by the gaps therebetween.

On the other hand, in the gas circuit breaker according to the first embodiment, the second link group 114 is omitted to thereby eliminate the energy loss of the driving force caused by the second link group 114. This makes it possible to reduce the total energy loss of the driving force transferred from the actuator 15.

Further, the omission of the second link group 114 leads to the decrease in the number of components, thereby reducing the cost and failure rate and improving maintenance.

In the conventional gas circuit breaker shown in FIG. 11, the insulating operation rod 109 and the output shaft 113 of the actuator 112 are arranged at about 90 degrees with each other.

For that reason, when the operating mechanism 111 is taken out from the unit box 110 for the maintenance or replacement of the actuator 112 and the like, the container supports 115 become obstacles. The operating mechanism 111 cannot be removed in the longitudinal direction of the container 101 and instead, should be removed in the direction perpendicular to the longitudinal direction of the container 101 (in the direction perpendicular to the sheet surface in FIG. 11).

In general, since a plurality of gas circuit breakers is arranged side by side along the direction perpendicular to the longitudinal direction of the container 101, in case of taking out the operating mechanism 111 in that direction, it is necessary to provide a work space between the adjoining gas circuit breakers.

Figure 2:
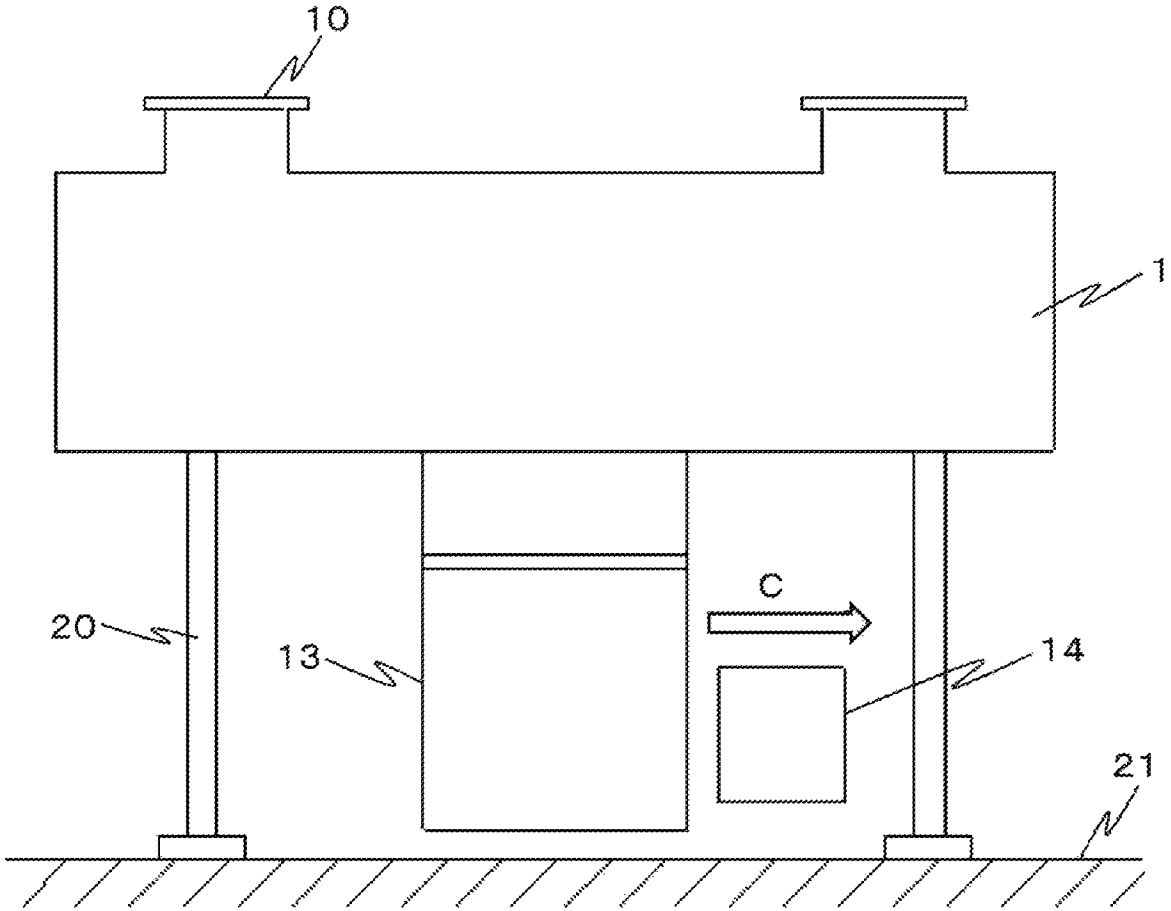
FIG. 2 is a front view showing a taking-out direction of an operating mechanism in the gas circuit breaker according to the first embodiment.

In contrast, according to the gas circuit breaker of the first embodiment shown in FIGS. 1 and 2, the output shaft 18 of the actuator 15 is arranged in a coaxial relationship with the insulating operation rod 12 and the operating mechanism 14 is arranged at a side of the output shaft 18 opposite to the insulating operation rod 12.

Therefore, as shown in FIG. 2, it is possible to secure a sufficient space between the unit box 13 and the container supports 20. This makes it possible to remove the operating mechanism 14 in the longitudinal direction of the container 1 (in the direction of arrow C).

With this manner, there is no need to provide a work space between the adjoining gas circuit breakers, which makes it possible to shorten the distance between the gas circuit breakers arranged side by side. This leads to the reduction of the installation space of the gas circuit breakers.

Second Embodiment

A second embodiment will be described with reference to FIGS. 3 and 4. The same parts as those of the gas circuit breaker according to the first embodiment will be designated by like reference symbols with no description made thereon.

Figure 3:
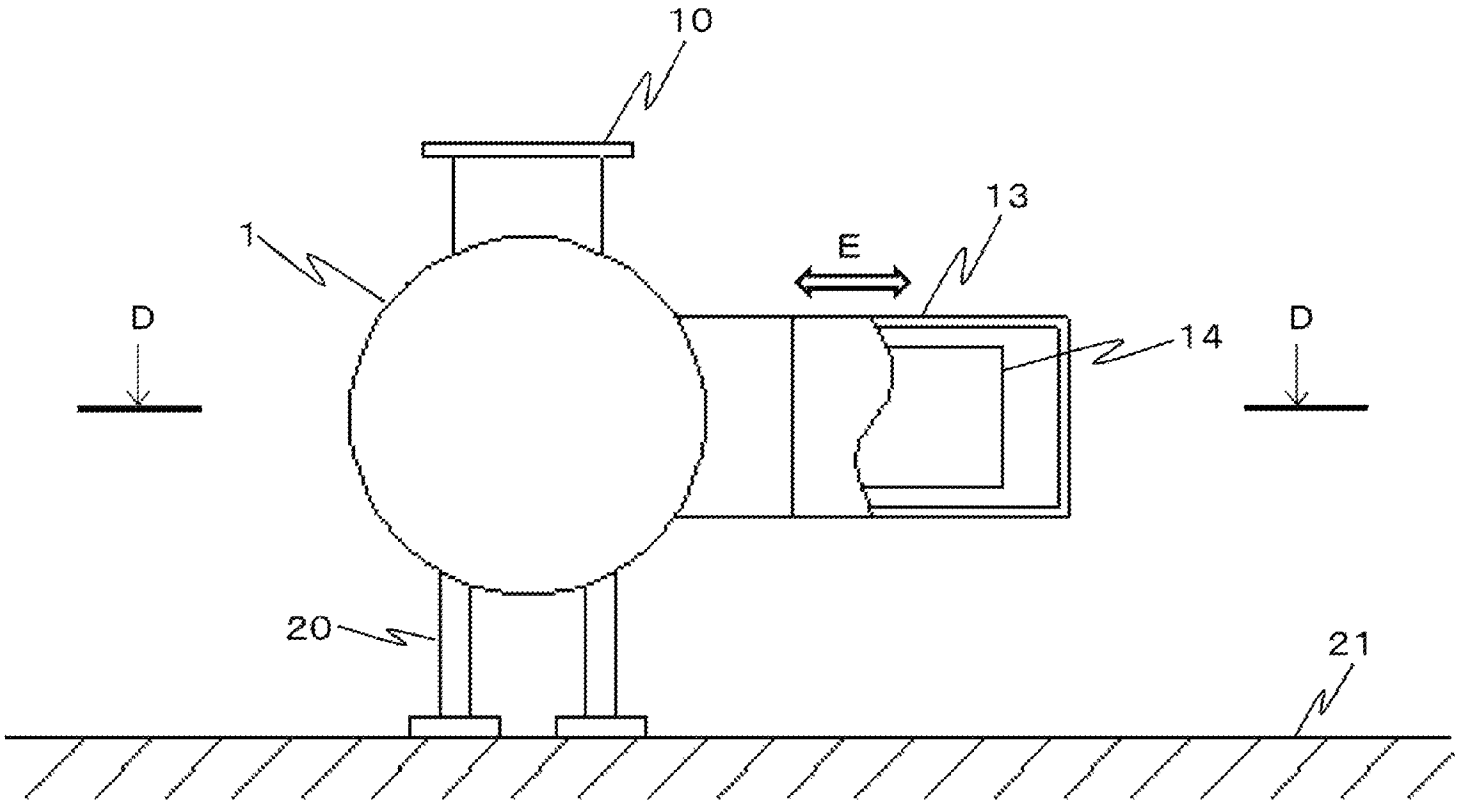
FIG. 3 is a side view of a gas circuit breaker according to a second embodiment.
Figure 4:
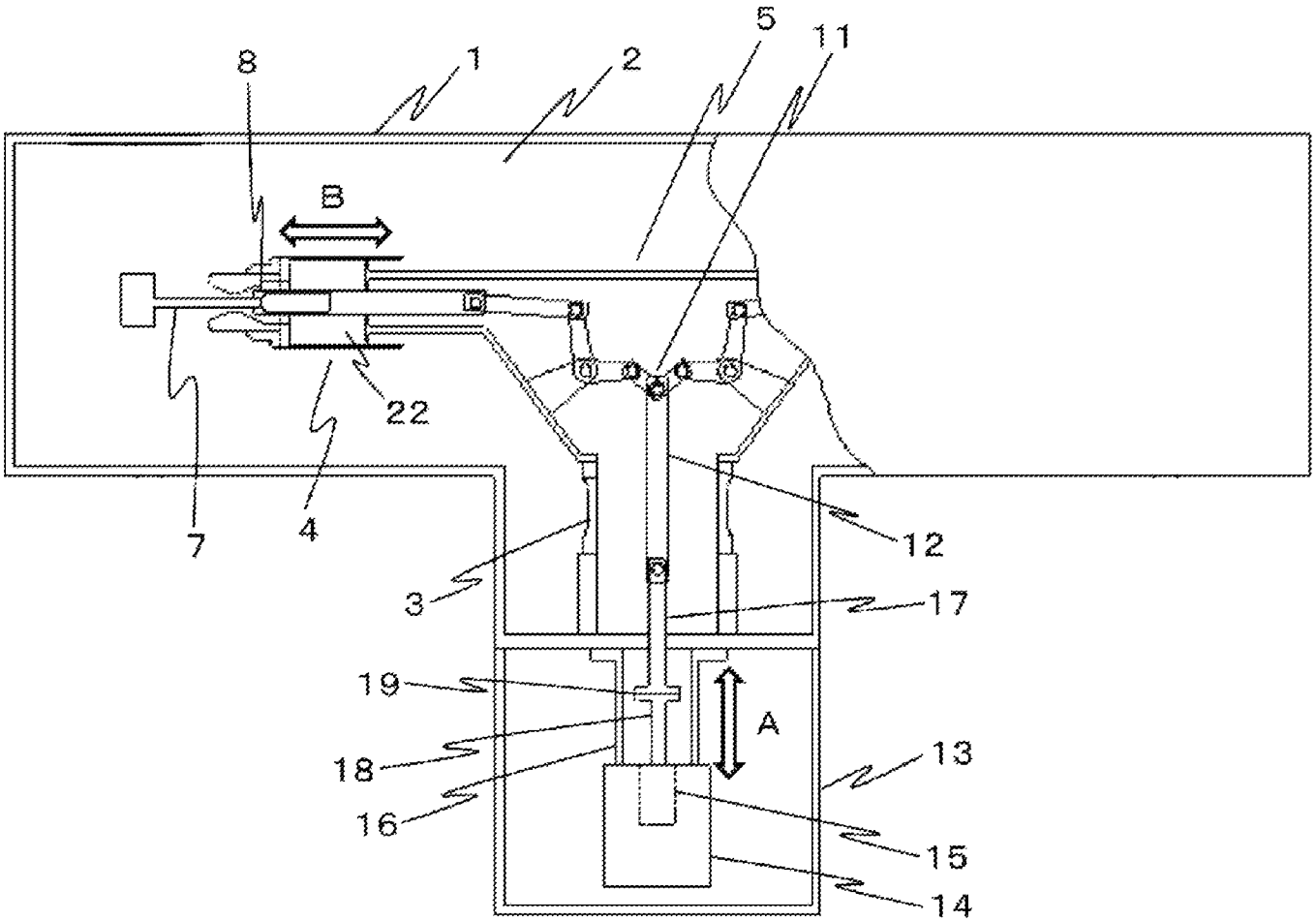
FIG. 4 is a sectional view taken along line D-D in FIG. 3.

FIG. 3 is a side view of a gas circuit breaker according to a second embodiment, while FIG. 4 is a section view taken along line D-D in FIG. 3.

The second embodiment differs from the first embodiment in that the center axis of the insulating operation rod 12 is positioned substantially parallel (including parallel) to the base 21.

The insulating operation rod 12, the seal rod 17 and the output shaft 18 of the actuator 15 are arranged substantially on the same axis as in the first embodiment. Therefore, the operation direction of the output shaft 18 of the actuator 15 indicated by arrow E in FIG. 3 is substantially parallel to the base 21.

According to the gas circuit breaker of the second embodiment as configured above, since the center axis of the insulating operation rod 12 is positioned substantially parallel to the base 21, in addition to the effects obtained in the first embodiment, it is possible to reduce the height of the gas circuit breaker. This makes it possible to enhance the quake resistance and the maintainability.

Third Embodiment

A third embodiment will be described with reference to FIGS. 5 and 6. The same parts as those of the gas circuit breakers according to the first and second embodiments will be designated by like reference symbols with no description made thereon.

Figure 5:
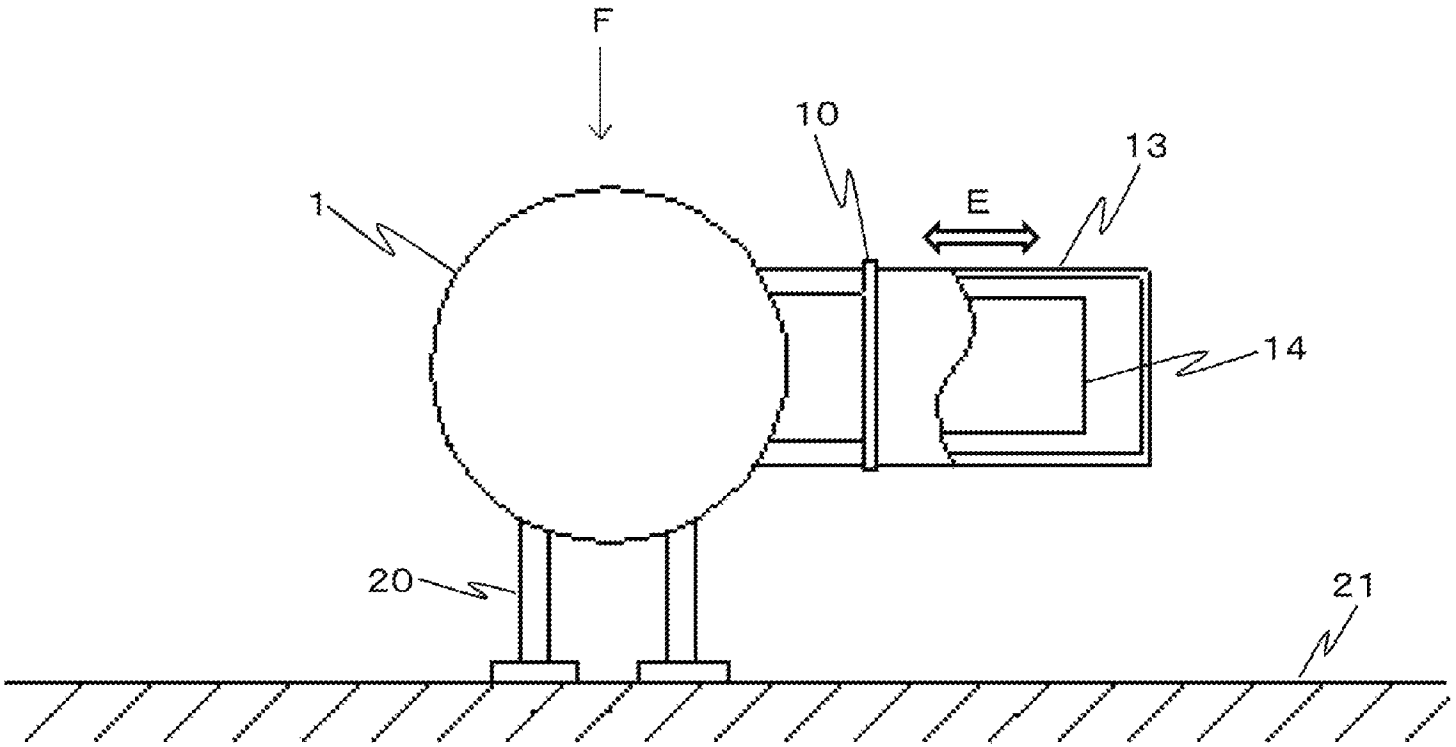
FIG. 5 is a side view of a gas circuit breaker according to a third embodiment.
Figure 6:
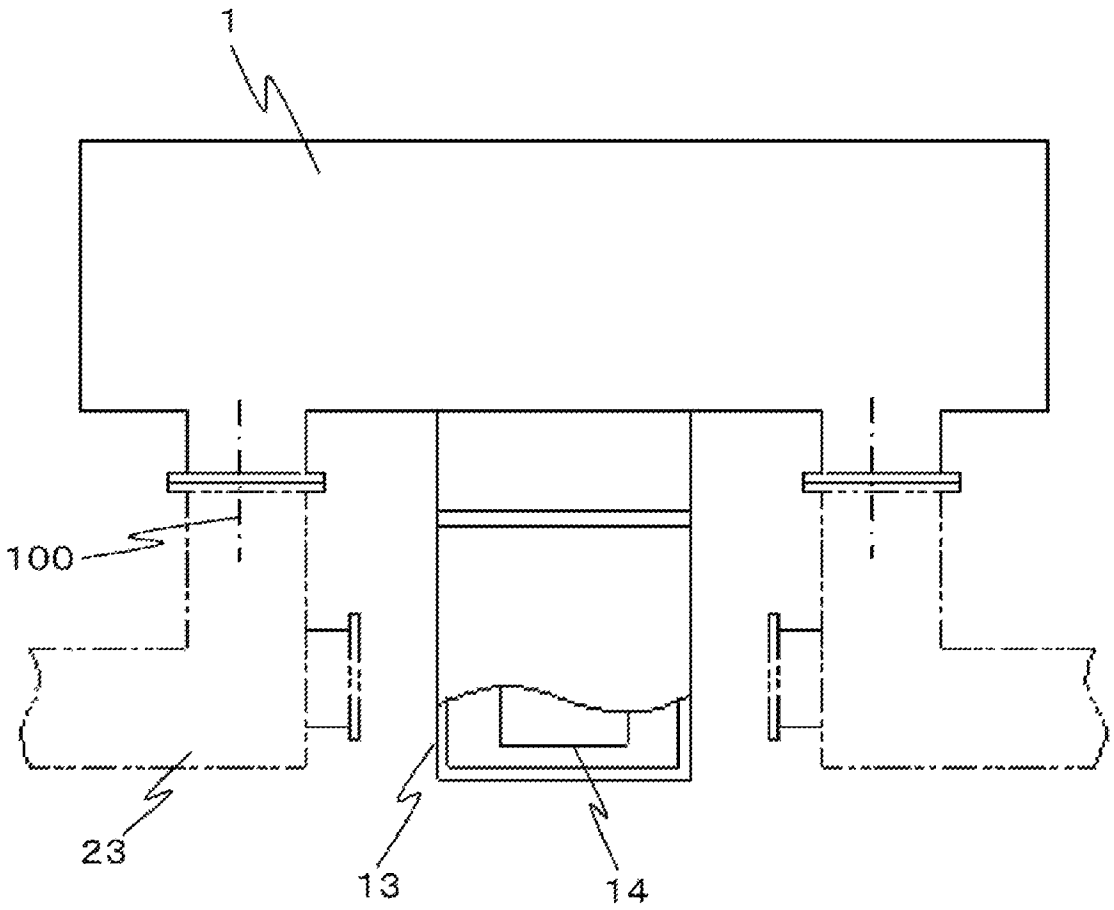
FIG. 6 is a view seen in the direction of arrow F in FIG. 5.

FIG. 5 is a side view of a gas circuit breaker according to a third embodiment, while FIG. 6 is a view seen in the direction of arrow F in FIG. 5.

The third embodiment differs from the second embodiment in that the center axis 100 of the interface portion 10 and the center axis of the insulating operation rod 12 are positioned substantially parallel (including parallel) with each other.

According to the gas circuit breaker of the third embodiment, as shown in FIG. 6, the elements 23 of a gas insulated switchgear (GIS) such as a bus conductor and a bushing attached to the interface portion 10 can be suppressed in their height to a height substantially equal to the height of the container 1. That is, it is possible to reduce the overall height of the GIS.

Further, since the space existing around the unit box 13 can be effectively utilized, it is possible to reduce the overall installation space of the GIS.

While the center axis 100 of the interface portion 10 extends in the same direction as a projection direction of the unit box 13 in FIG. 6, the center axis 100 may extend in the 180° opposite direction with respect to the projection direction of the unit box 13.

Fourth Embodiment

A fourth embodiment will be described with reference to FIG. 7. The same parts as those of the gas circuit breakers according to the first, second and third embodiments will be designated by like reference symbols with no description made thereon.

Figure 7:
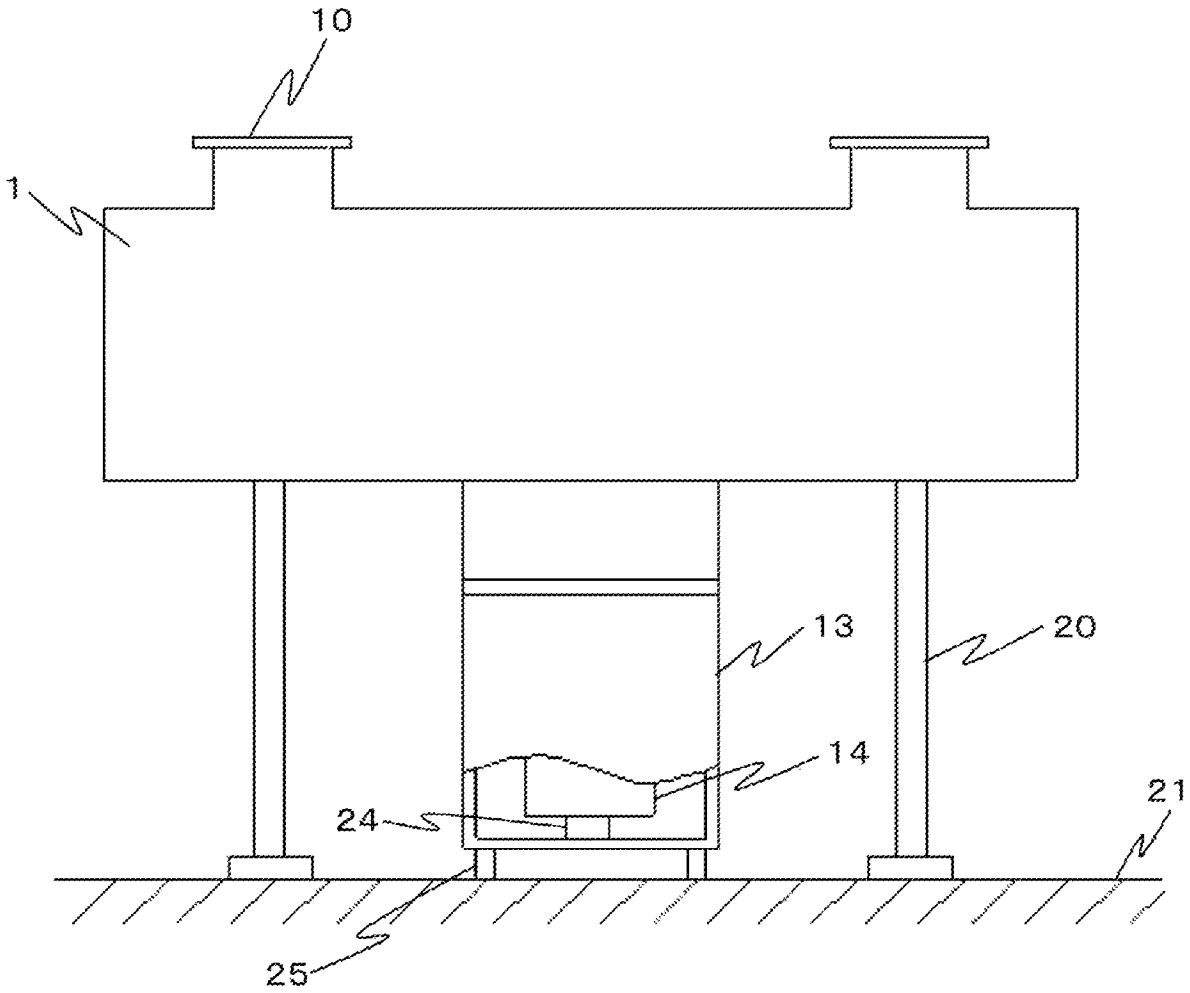
FIG. 7 is a front view of a gas circuit breaker according to a fourth embodiment.

FIG. 7 is a front view of a gas circuit breaker according to a fourth embodiment.

The fourth embodiment differs from the first, second and third embodiments in that the operating mechanism 14 and the unit box 13 are fixed to each other and that the unit box 13 is fixed to the base 21.

More specifically, for example, an operating mechanism fastening member 24 and unit box fastening members 25 are provided.

As shown in FIG. 7, the operating mechanism fastening member 24 is installed between an outer surface of the operating mechanism 14 and the surface of the unit box 13 to fasten the operating mechanism 14 and the unit box 13 together.

In FIG. 7, as one example, the operating mechanism fastening member 24 is arranged between the bottom surface of the operating mechanism 14 and the inner surface of the unit box 13 facing the bottom surface of the operating mechanism 14.

The unit box fastening members 25 fasten the outer surface of the unit box 13 and the base 21 together. In FIG. 7, as one example, the unit box fastening members 25 are arranged between the bottom surface of the unit box 13 and the base 21.

According to the gas circuit breaker of the fourth embodiment configured above, the operating mechanism 14 and the unit box 13 are fastened by the operating mechanism fastening member 24. The unit box 13 and the base 21 are fastened by the unit box fastening members 25. Therefore, in addition to the effects obtained in the first embodiment, it is possible to enhance the stability of the gas circuit breaker. Especially, it is possible to reduce the vibration propagated to the container 1 and so forth during the operation of the actuator 15.

This makes it possible to increase the quake resistance while achieving cost reduction by lowering the rigidity of the components of the gas circuit breaker.

Although an example in which one operating mechanism fastening member 24 and two unit box fastening members 25 are provided is shown in FIG. 7, the number of the operating mechanism fastening member 24 and the unit box fastening members 25 are not limited thereto.

Further, although a configuration in which the operating mechanism fastening member 24 and the unit box fastening member 25 are added with respect to the first embodiment is being shown in FIG. 7, it may be possible to employ a configuration in which only the operating mechanism fastening member 24 is added to the second embodiment or the third embodiment. This makes it possible to obtain the same effects as mentioned above.

However, it is not necessarily required to include the operating mechanism fastening member 24 or the unit box fastening member 25. As long as the operating mechanism 14 and the unit box 13 are fixed to each other or the unit box 13 and the base 21 are fixed to each other, it is possible to enhance the stability of the gas circuit breaker.

Fifth Embodiment

A fifth embodiment will be described with reference to FIG. 8. The same parts as those of the gas circuit breakers according to the first to fourth embodiments will be designated by like reference symbols with no description made thereon.

Figure 8:
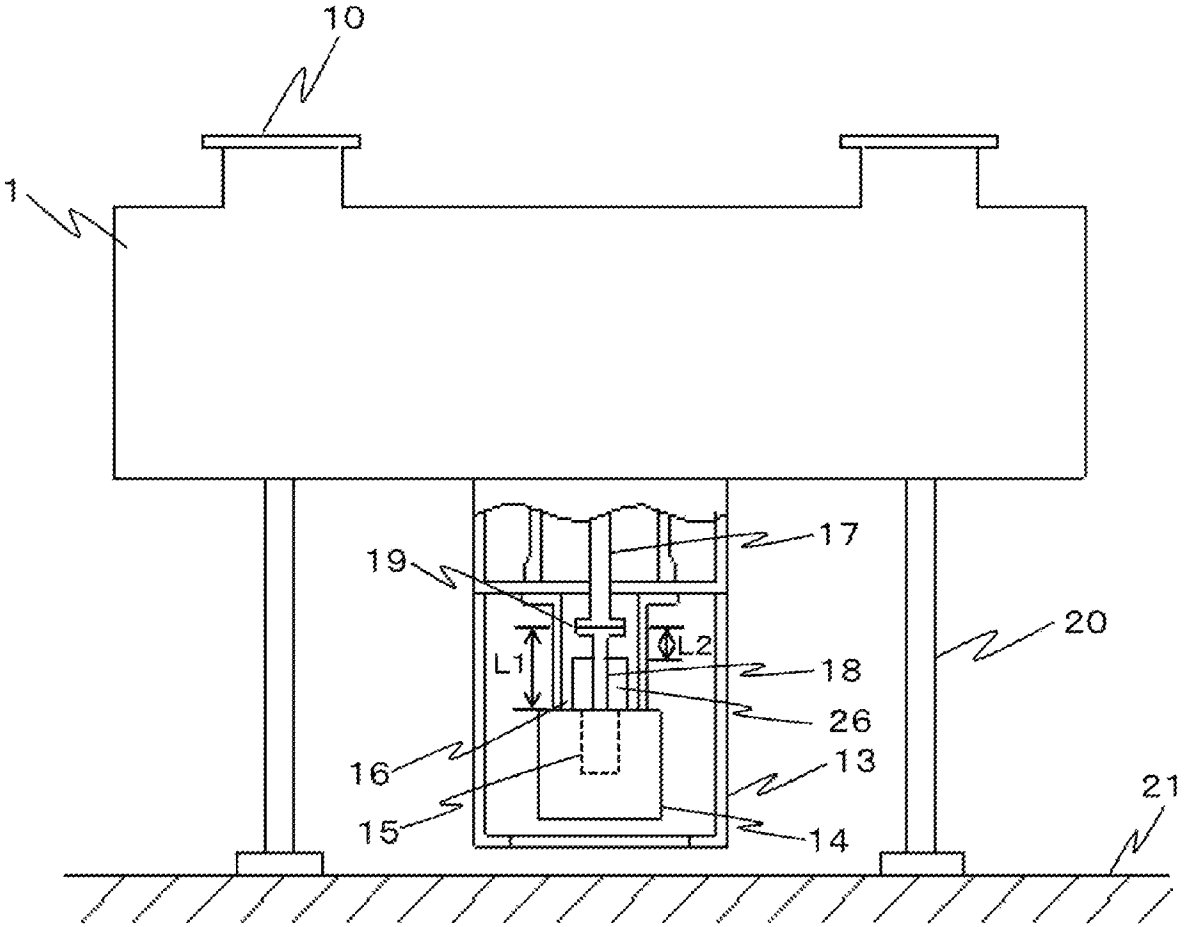
FIG. 8 is a front view of a gas circuit breaker according to a fifth embodiment.

FIG. 8 is a front view of a gas circuit breaker according to a fifth embodiment.

The fifth embodiment differs from the first to fourth embodiments in that the unit support 16 includes a cutout 26.

The cutout 26 is formed in an end of the unit support 16 near the operating mechanism 14 and has a size large enough to take out the output shaft 18 of the actuator 15 therethrough.

According to the gas circuit breaker of the fifth embodiment as configured above, when taking out the operating mechanism 14 from the unit box 13, it is possible to take out the output shaft 18 through the cutout 26 after disconnecting the connection portion 19 between the seal rod 17 and the output shaft 18 of the actuator 15.

In other words, for the removal of the operating mechanism 14 from the unit box 13 when the cutout 26 is not provided, it is necessary to move the actuator 15 toward the base 21 by distance L1 after disconnecting the connection portion 19 between the seal rod 17 and the output shaft 18 of the actuator 15.

On the other hand, since the present embodiment is provided with the cutout 26, it is only necessary that the actuator 15 is moved toward the base 21 by distance L2. This makes it possible to shorten the movement distance of the operating mechanism 14.

With this manner, it is possible to facilitate the removal work of the operating mechanism 14. Since the movement distance of the operating mechanism 14 can be made shorter, it is possible to reduce the size of the unit box 13 and to reduce the height of the gas circuit breaker. Since the bottom surface of the unit box 13 is detachable, the removal work becomes easier to perform.

Although a configuration in which the cutout 26 is applied to the first embodiment is shown in FIG. 8, the cutout 26 may be applied to the second, third and fourth embodiments. This makes it possible to facilitate the removal work of the operating mechanism 14.

Sixth Embodiment

A sixth embodiment will be described with reference to FIG. 9. The same parts as those of the gas circuit breakers according to the first to fifth embodiments will be designated by like reference symbols with no description made thereon.

Figure 9:
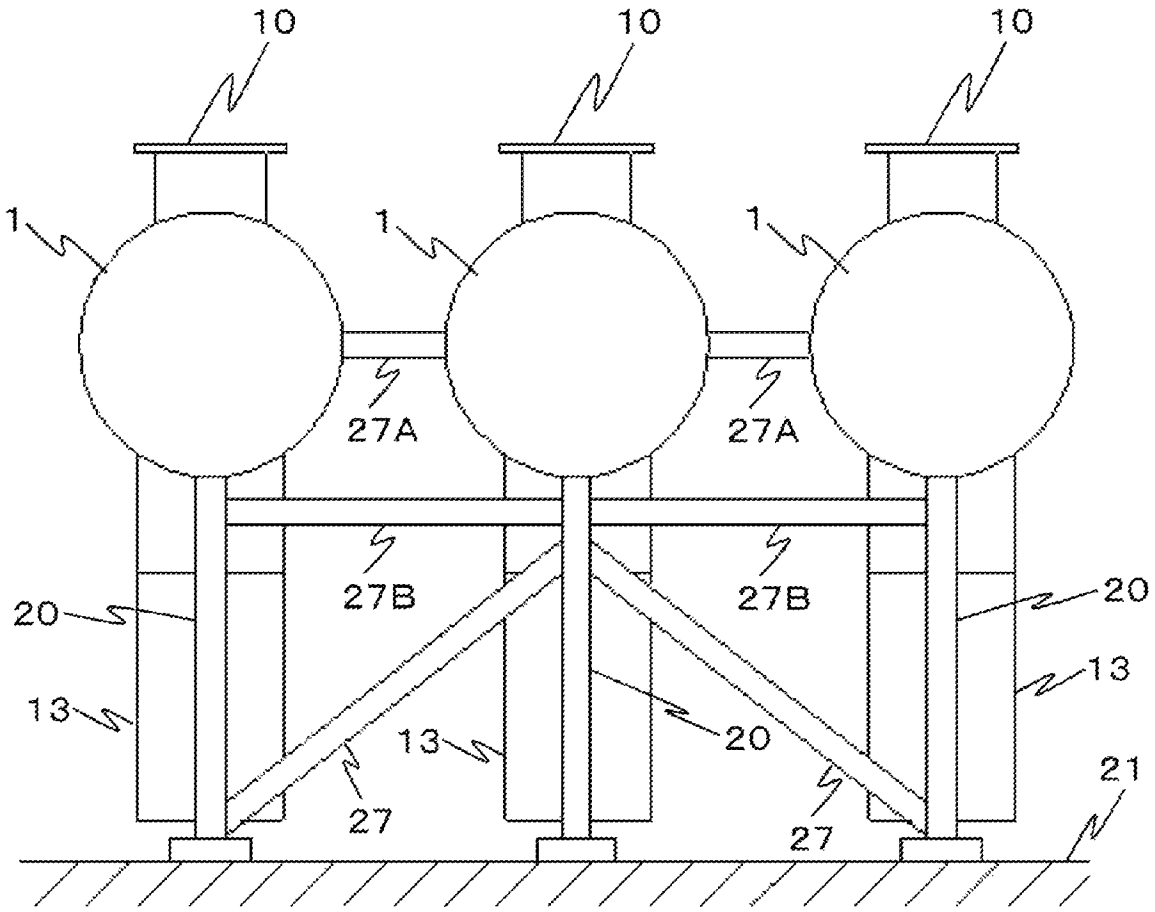
FIG. 9 is a side view of a gas circuit breaker according to a sixth embodiment.

FIG. 9 is a side view of a gas circuit breaker according to a sixth embodiment.

In the sixth embodiment, there is illustrated a three-phase structure in which three gas circuit breakers according to the first embodiment are arranged side by side in a parallel relationship with the longitudinal direction of the container 1.

As shown in FIG. 9, the containers 1 of the individual gas circuit breakers adjoining each other are fixed together by interconnection members 27A directly fastening the respective containers 1. The container supports 20 supporting the containers 1 of the respective gas circuit breakers are fixed to each other by interconnection members 27B.

According to the gas circuit breaker of the sixth embodiment as configured above, the containers 1 or the container supports 20 of the respective gas circuit breakers adjoining each other are fixed by the interconnection members 27A or 27B, respectively. It is therefore possible to stabilize the gas circuit breaker and to enhance the quake resistance.

Along with the enhancement of the quake resistance, the number of the container supports 20 per one gas circuit breaker can be reduced from four to two as shown in FIG. 9. This contributes to the reduction of costs while maintaining the stability of the gas circuit breaker.

As described above in the first embodiment, since the output shaft 18 of the actuator 15 is arranged in a coaxial relationship with the insulating operation rod 12, it is possible to shorten the distance between the gas circuit breakers adjoining each other. Therefore, the length of the interconnection members 27A and 27B can be made small. This can contribute to the reduction of costs.

Figure 10:
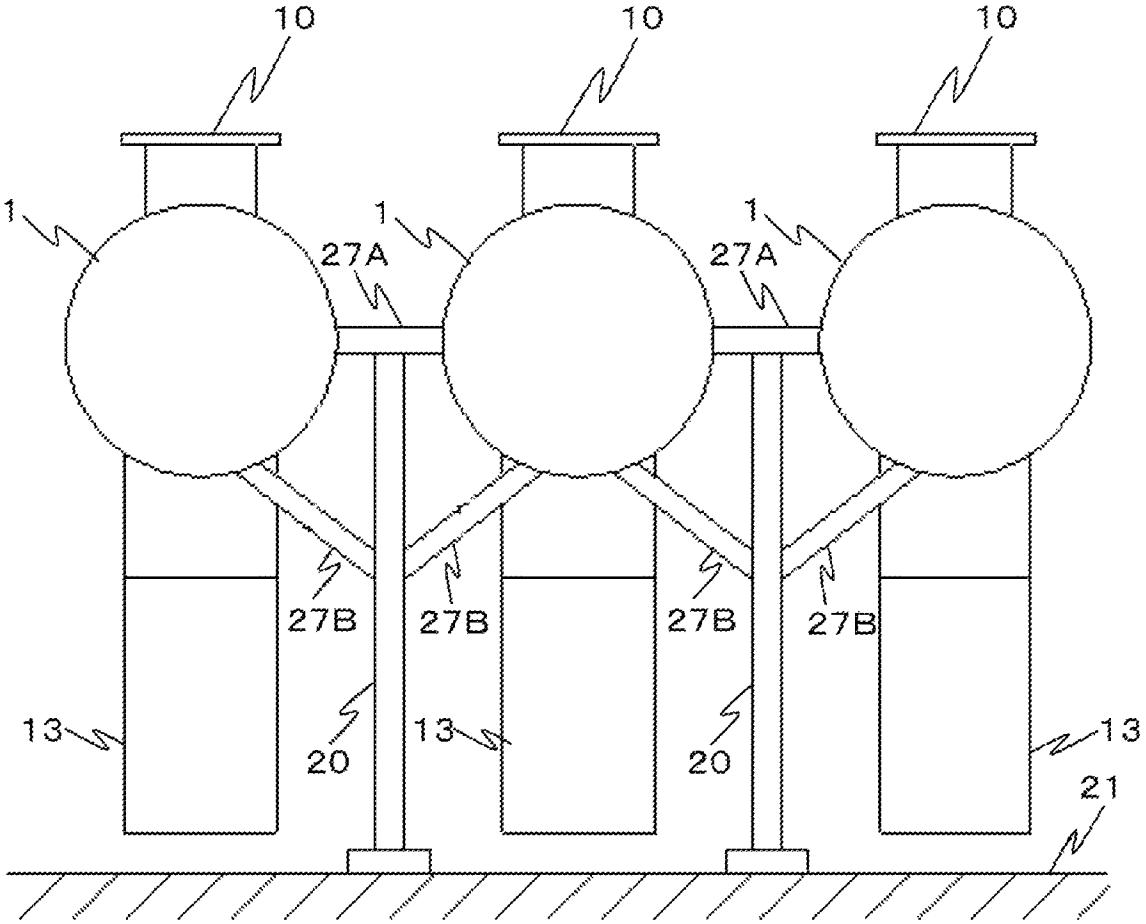
FIG. 10 shows a modification of the gas circuit breaker according to the sixth embodiment.

In a modified example of the present embodiment, as shown in FIG. 10, the container supports 20 may be attached to the interconnection members 27A. With this configuration, it is possible to secure a space around the unit box 13. This facilitates the work of removing the operating mechanism 14 from the unit box 13.

In the first to sixth embodiments described above, there is illustrated by way of example the double-break gas circuit breaker that includes two interrupting chambers 4. However, the present invention may be applied to a single-point-break gas circuit breaker including one interrupting chamber 4 or a multiple-point-break gas circuit breaker including three or more interrupting chambers 4. Even in this case, it is possible to obtain the same effects as available in the respective embodiments.

While certain embodiments of the present invention have been described above, these embodiments are presented by way of example and are not intended to limit the scope of the present invention. These embodiments can be modified in many different forms. Various kinds of omission, substitution and modification may be made without departing from the scope and spirit of the present invention. These embodiments and the modifications thereof fall within the scope and spirit of the present disclosure and are included in the scope of the present disclosure recited in the claims and the equivalent thereof.

What is claimed is:

1. A gas circuit breaker, comprising:

a hermetically-sealed container filled with an arc extinguishing gas;

a fixed contact arranged horizontally within the container;

a movable contact arranged to face the fixed contact and configured to move in a horizontal direction of the container, the movable contact capable of contacting or separating from the fixed contact;

an insulating operation rod arranged vertically within the container having a first end connected to an end of the movable contact opposite to the fixed contact through a link group at an angle of about 90 degrees with respect to the movable contact;

a seal rod arranged vertically within the container having a first end connected to a second end of the insulating operation rod and a second end connected to an output shaft of an actuator and configured to transfer the driving force of the output shaft of the actuator to the insulating operation rod and the movable contact through a single link group, the seal rod configured to maintain air-tightness of a portion through which the seal rod passes;

said actuator arranged beneath the insulating operation rod and the seal rod.

2. The gas circuit breaker of claim 1, further comprising:

a seal rod arranged between the other end of the insulating operation rod and the output shaft of the actuator and configured to transfer the driving force of the output shaft of the actuator to the other end of the insulating operation rod, the seal rod configured to maintain air-tightness of a portion through which the seal rod passes.

3. The gas circuit breaker of claim 1, further comprising:

an operating mechanism for accommodating the actuator therein, the operating mechanism arranged at a side of the output shaft opposite to the insulating operation rod.

4. The gas circuit breaker of claim 3, further comprising:

a unit support configured to support the container and the operating mechanism while a connection portion for interconnecting the seal rod and the actuator is positioned therewithin.

5. The gas circuit breaker of claim 4, wherein the unit support includes a cutout formed at its end near the operating mechanism.

6. The gas circuit breaker of claim 3, further comprising:

a unit box attached to an external portion of the container and configured to accommodate the operating mechanism therein.

7. The gas circuit breaker of claim 6, wherein the unit box has at least one detachable surface.

8. The gas circuit breaker of claim 6, wherein the operating mechanism and the unit box are fixed to each other.

9. The gas circuit breaker of claim 6, wherein the unit box is fixed to a base.

10. The gas circuit breaker of claim 1, wherein the center axis of the insulating operation rod is substantially parallel to a base.

11. The gas circuit breaker of claim 1, wherein the container includes an interface portion through which a main circuit conductor connected to the fixed contact passes, the center axis of the interface portion being substantially parallel to the center axis of the insulating operation rod.

12. The gas circuit breaker of claim 1, wherein at least adjoining containers of a plurality of gas circuit breakers arranged side by side are fixed to each other.

* * * * *